US006409592B1

(12) United States Patent
McCoy et al.

(10) Patent No.: US 6,409,592 B1
(45) Date of Patent: Jun. 25, 2002

(54) WHITE INK SECURITY FEATURE FOR MAILER TYPE BUSINESS FORMS

(75) Inventors: Deborah L. McCoy, Lewiston; David G. Wagner, Amherst, both of NY (US)

(73) Assignee: Moore North America, Stamford, CT (US)

( * ) Notice: Subject to any disclaimer, the term of this patent is extended or adjusted under 35 U.S.C. 154(b) by 320 days.

(21) Appl. No.: 08/954,156

(22) Filed: Oct. 20, 1997

(51) Int. Cl.[7] ..... B41L 1/26

(52) U.S. Cl. ..... 462/6; 229/69; 229/306; 283/116; 283/902; 462/64; 462/900

(58) Field of Search ..... 283/116, 901, 283/902, 72, 93; 462/900, 65, 64, 13, 6; 229/303, 305, 306, 69

(56) References Cited

U.S. PATENT DOCUMENTS 4,092,449 A * 5/1978 Bernstein ..... 283/102
5,294,041 A * 3/1994 Whiteside ..... 283/116
5,368,334 A 11/1994 Christy et al.
5,376,048 A * 12/1994 Whiteside ..... 283/116
5,413,532 A * 5/1995 Raby ..... 462/900
5,464,255 A * 11/1995 Schildmeyer ..... 283/116
5,595,404 A * 1/1997 Skees ..... 283/116
5,779,612 A * 7/1998 Whitney ..... 283/116

FOREIGN PATENT DOCUMENTS

AU 17885 76 3/1978
GB 430801 6/1935

* cited by examiner

*Primary Examiner*—A. L. Wellington
*Assistant Examiner*—Monica Carter
(74) *Attorney, Agent, or Firm*—Nixon & Vanderhye PC

(57) ABSTRACT

A business form, particularly a mailer type business form, is constructed from a sheet of paper. The paper has first and second areas, the first area having security indicia positively imaged in non-fluorescent white ink. The second area, which is preferably immediately adjacent the first area, is substantially covered by non-fluorescent white ink, with security indicia reverse imaged on it. Some security indicia may extend from the first area to the second area, being positively imaged white ink in the first area, and reverse imaged indicia surrounded by white ink in the second area. The mailer may be formed into panels by lines of weakness, and may have areas with security pantographs thereon, or areas with security printing over a portion thereof and portions distinct from the security printing receiving outgoing address indicia and postage indicia, and possibly return address indicia.

20 Claims, 4 Drawing Sheets

WHITE INK SECURITY FEATURE FOR MAILER TYPE BUSINESS FORMS

BACKGROUND AND SUMMARY OF THE INVENTION

Many business forms, particularly mailer type business forms, have the need to provide security for some of the information associated therewith so that only the addressee who opens up a mailing can see the confidential information, or a security document (such as a check, money order, negotiable instrument, or the like) or what information is on it, contained therein is in fact provided. Typical mailer type business forms are shown in U.S. Pat. Nos. 5,294,041, 5,553,774, 5,376,048, 5,174,493, and 5,201,464, which are formed from a single sheet of paper. Other type mailers (including some embodiments in U.S. Pat. No. 5,174,493) include inserts, and other business forms aside from mailers, either single ply or multiple ply, also often have the need for confidentiality. Also, many such business forms require security features so as to minimize the possibility that the documents will be misused.

Increasing the security of printed matter inside a mailer can be effected by increasing the paper weight, printing dense patterns or masking printing on various areas or panels thereof, or by printing using non-transparent white ink. Security features are then provided in different manners including by using microtext, watermarks, security printing in white ink, or the like. Oftentimes security printing in white ink is provided utilizing fluorescent white ink.

According to the present invention a business form is provided which provides excellent security, even when utilized as a mailer type business form, for the contained documents or panels, including negotiable instruments, while at the same time providing a security feature so as to enhance the document's ability to preclude unauthorized utilization thereof. This is accomplished according to the present invention by utilizing white ink in two distinct manners, typically in adjacent portions of the same face of the business form, in one area the white ink used for security printing, while in the other area the white ink is used for enhanced opacity, with the security printing reverse printed thereon so as to provide both opacity and security functions. The white ink utilized according to the invention is preferably non-fluorescent since fluorescent white inks cause problems with scanners.

According to one aspect of the present invention a business form is provided comprising: A sheet of paper having first and second areas. The first area having security indica positively imaged in white ink thereon. And, the second area substantially covered by white ink with security indicia reverse imaged thereon. The first and second areas are typically immediately adjacent each other, and some security indicia extends from the first area to the second area, being positively imaged white ink in the first area, and reverse imaged indicia surrounded by white ink in the second area. The white ink in both the first and second areas is preferably non-fluorescent, and may have a high density, such as about 12–14 lbs. per gallon (e.g. about 13 lbs. per gallon).

The business form may be a mailer type business form, and may include a third area. The third area may have a security pantograph (or camouflage printing) thereon. A fourth area may also have security printing over a portion thereof, and portions distinct from the security printing receiving outgoing address indicia and postage indicia (and perhaps return address indicia) of the mailer.

According to another aspect of the present invention a mailer type business form is provided. The mailer type business form comprises: A substantially quadrate sheet of paper having first and second faces, substantially parallel top and bottom edges, and substantially parallel side edges substantially perpendicular to the top and bottom edges. At least one line of weakness substantially parallel to the top and bottom edges and dividing the sheet into at least first and second panels. The first face of the first panel having outgoing address, return address, and postage indicia thereon. And, another face or panel of the sheet aside from the first panel first face having first and second area, the first area having security indicia positively imaged in white ink thereon; and the second area substantially covered by white ink with security indicia reverse imaged thereon.

The first and second areas are typically immediately adjacent each other, and have the type of ink in the security indicia extending from one area to the other as described above. The first face of the first panel may have security printing over a portion thereof, and portions distinct from the security printing receiving the outgoing address indicia and the postage indicia. Typically at least two lines of weakness are provided substantially parallel to the top and bottom edges, dividing the sheet into at least first, second, and third panels. The second panel is adjacent the first panel and the third panel on the opposite side of the second panel from the first panel. In this case the panel or portion containing the white ink may comprise the first face of the third panel. The sheet may consist of the first, second, and third panels, and the mailer may be a C-fold type mailer (either conventional C-fold or eccentric C-fold), or other panels or faces may include the white ink thereon and the mailer be made a conventional Z-fold, eccentric Z-fold, or V-fold, or the like. More than three panels may also be provided and the mailer may be doubled C-folded, or have other conventional configurations.

The third panel, when separated from the rest of the sheet, may comprise a security document (such as a check, money order, bond, negotiable instrument, or the like) with security document indicia (such as bank name, monetary amount, payee, etc.) imaged on at least the second face of the third panel.

It is the primary object of the present invention to provide a business form, particularly a mailer type business form, with enhanced confidentiality, as well as enhanced security, so as to enhance the probability that the mailer will be delivered unopened to the addressee, and any security document associated therewith will be utilized only by the payee (outgoing addressee). This and other objects of the invention will become clear from an inspection of the detailed description of the invention and from the appended claims.

DETAILED DESCRIPTION OF THE DRAWINGS

Figure 1:
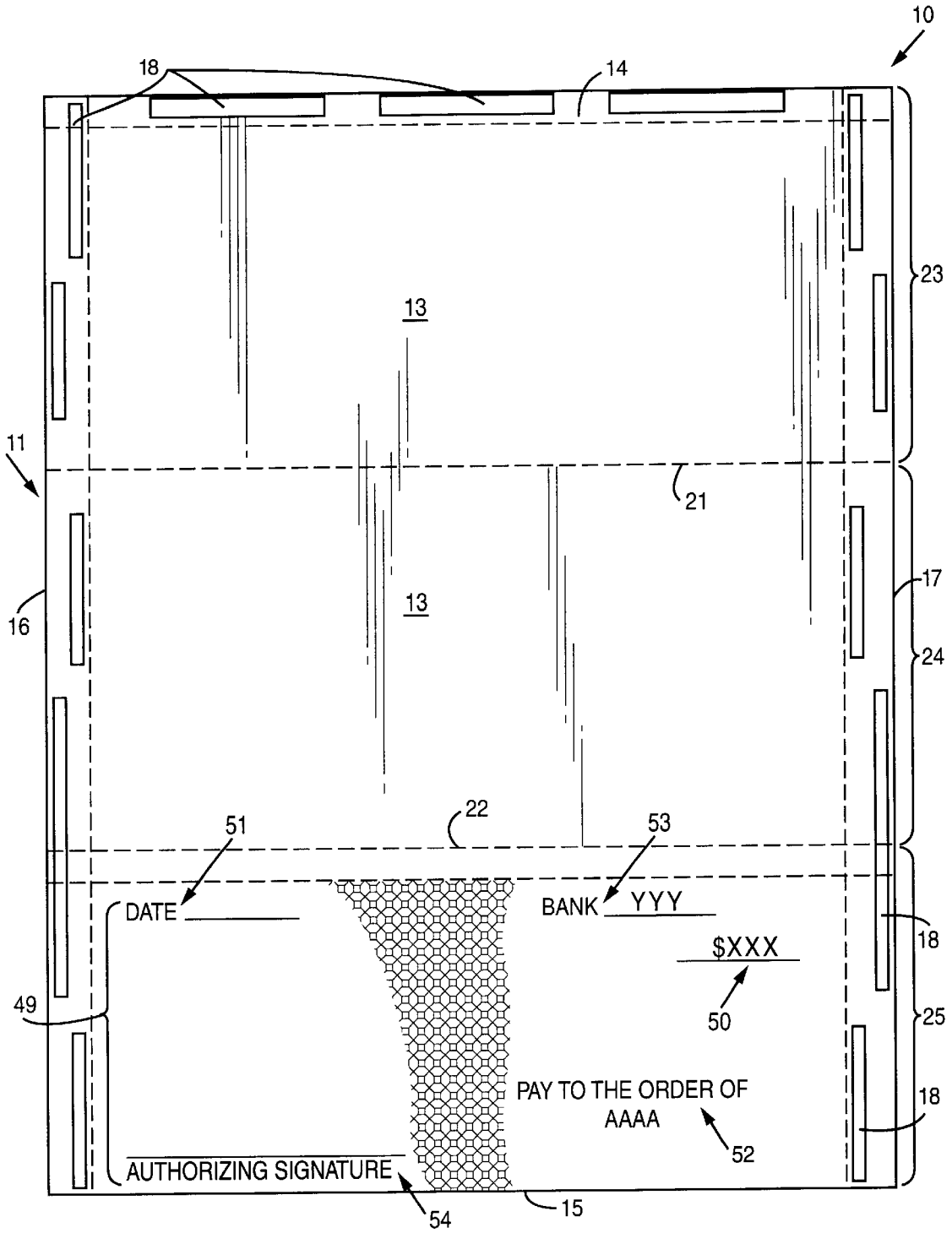
FIG. 1 is a top plan view of one face of a first exemplary form of a mailer intermediate type business form according to the invention.
Figure 2:
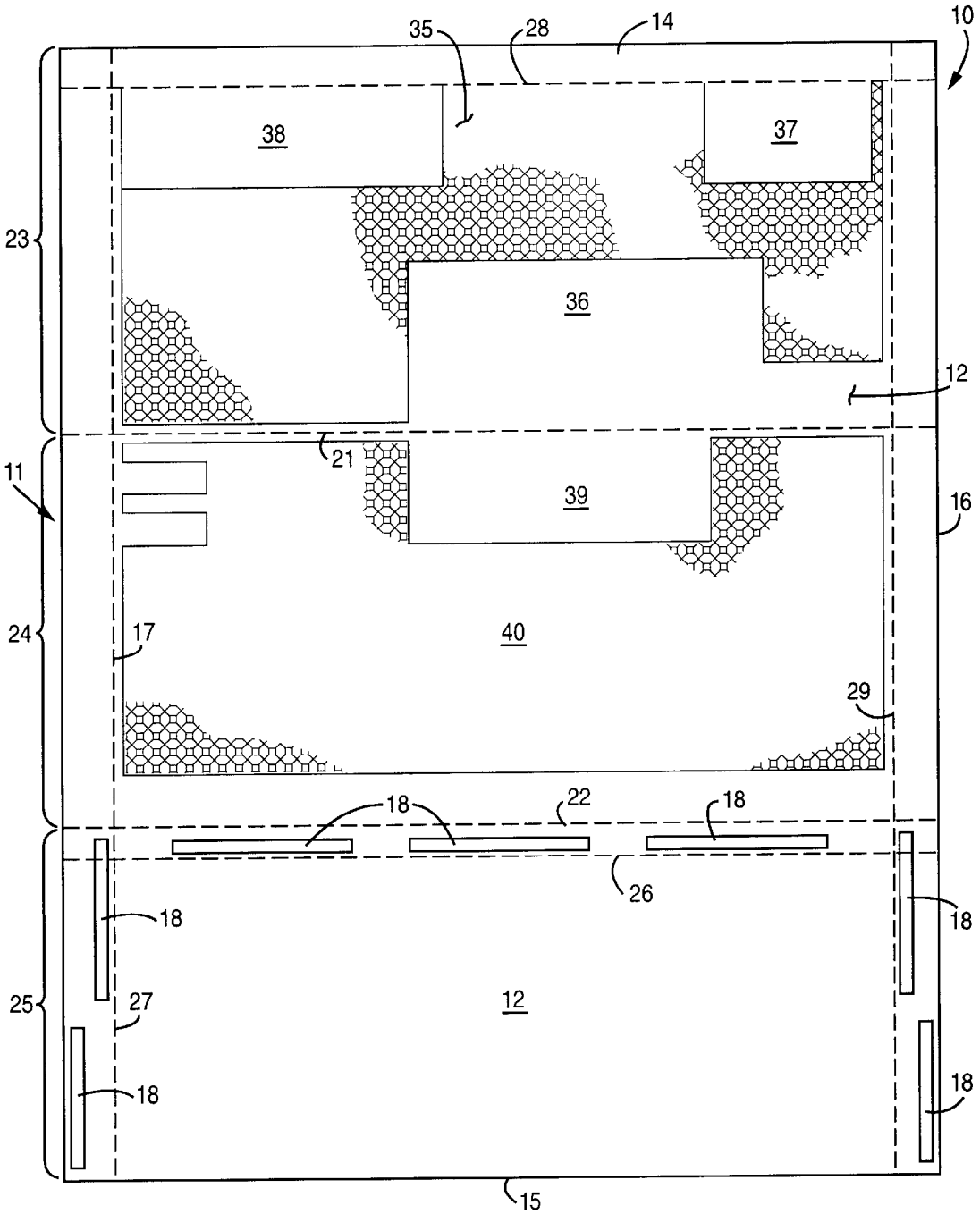
FIG. 2 is a view like that of FIG. 1 of the opposite face of the mailer intermediate type business form.

An exemplary mailer type business form according to the present invention is constructed from an intermediate, shown generally by reference numeral 10 in FIGS. 1 and 2. The intermediate 10, comprises a substantially quadrate sheet of paper 11 having a first face 12 (see FIG. 2) and a second face 13 (see FIG. 1) with substantially parallel top and bottom edges 14, 15, respectively, and substantially parallel side edges 16, 17 which are substantially perpendicular to the top and bottom edges 14, 15. In the exemplary form of the intermediate 10 illustrated in FIGS. 1 and 2, the business form 10 comprises a mailer type business form with pressure activated cohesive patterns 18 associated therewith to allow C, V, or Z folding of various panels of the mailer with respect to each other so as to bring the adhesive patterns 18 into contact with each other so that sealing therewith may be effected. Conventional type mailers utilizing such an adhesive sealing system are shown in U.S. Pat. Nos. 5,294,041, 5,174,493, and 5,201,464 (the disclosures of which are hereby incorporated by reference herein), and the sealing mechanism per se is conventional. While a pressure activated cohesive sealing system is preferred according to the invention, other sealing systems may be utilized, including rewettable adhesive, heat activated adhesive, or the like.

For the particular embodiment of the intermediate 10 illustrated in FIGS. 1 and 2, first and second lines of weakness 21, 22 are provided, which are substantially parallel to the top and bottom edges 14, 15 and divide the sheet 11 into first, second, and third panels 23, 24, and 25, respectively. Other lines of weakness, to allow detachment of various portions of the intermediate which are sealed by cohesive or adhesive, such as the lines of weakness 26, 27, 28, and 29, also may be provided. The lines of weakness 21, 22, and 26 through 29 may be any conventional lines of weakness, such as perforation lines.

Figure 3:
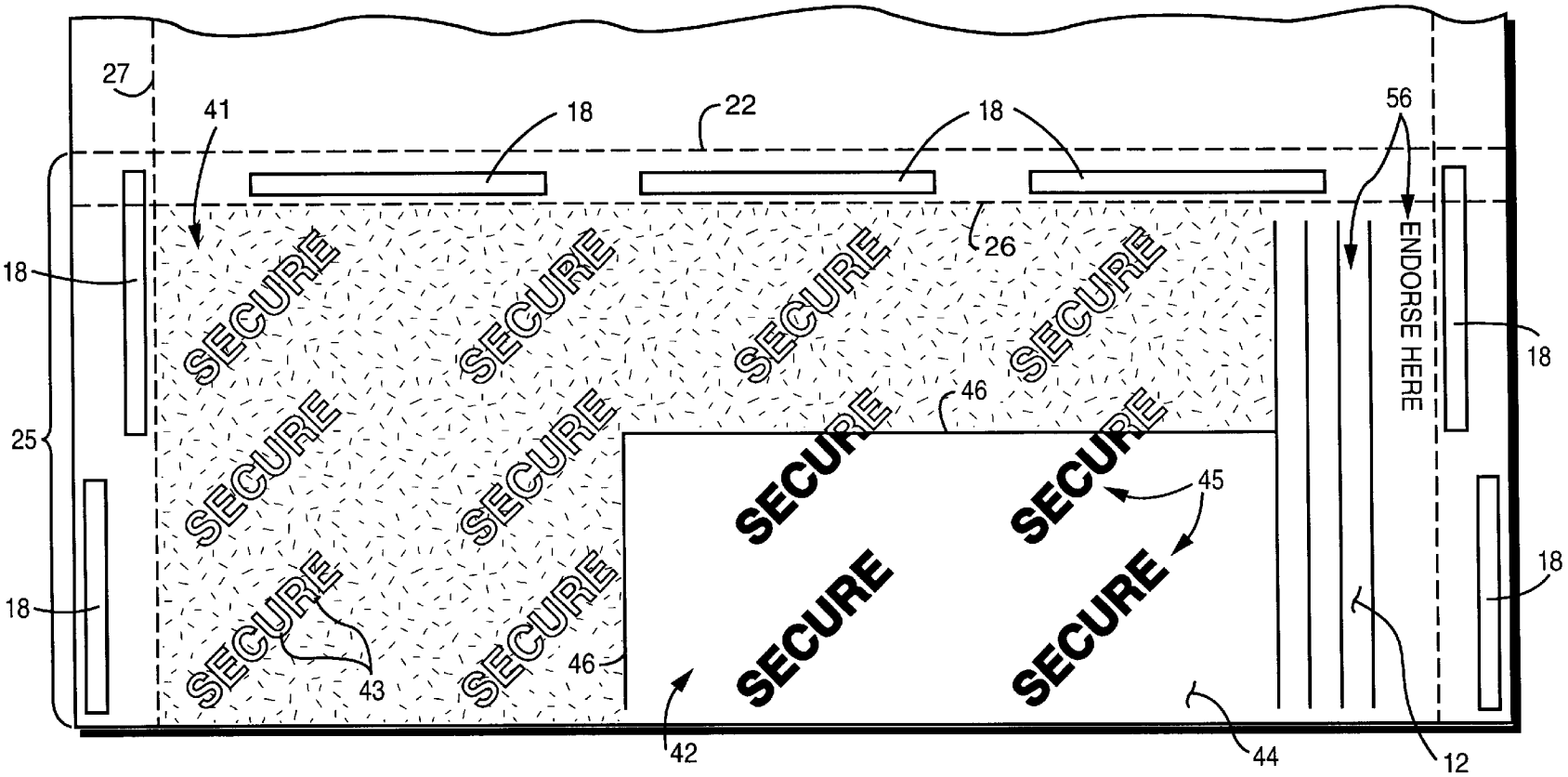
FIG. 3 is an enlarged detail view of the first face of the third panel of the business form of FIGS. 1 and 2 showing the confidentiality and security features thereof.
Figure 4:
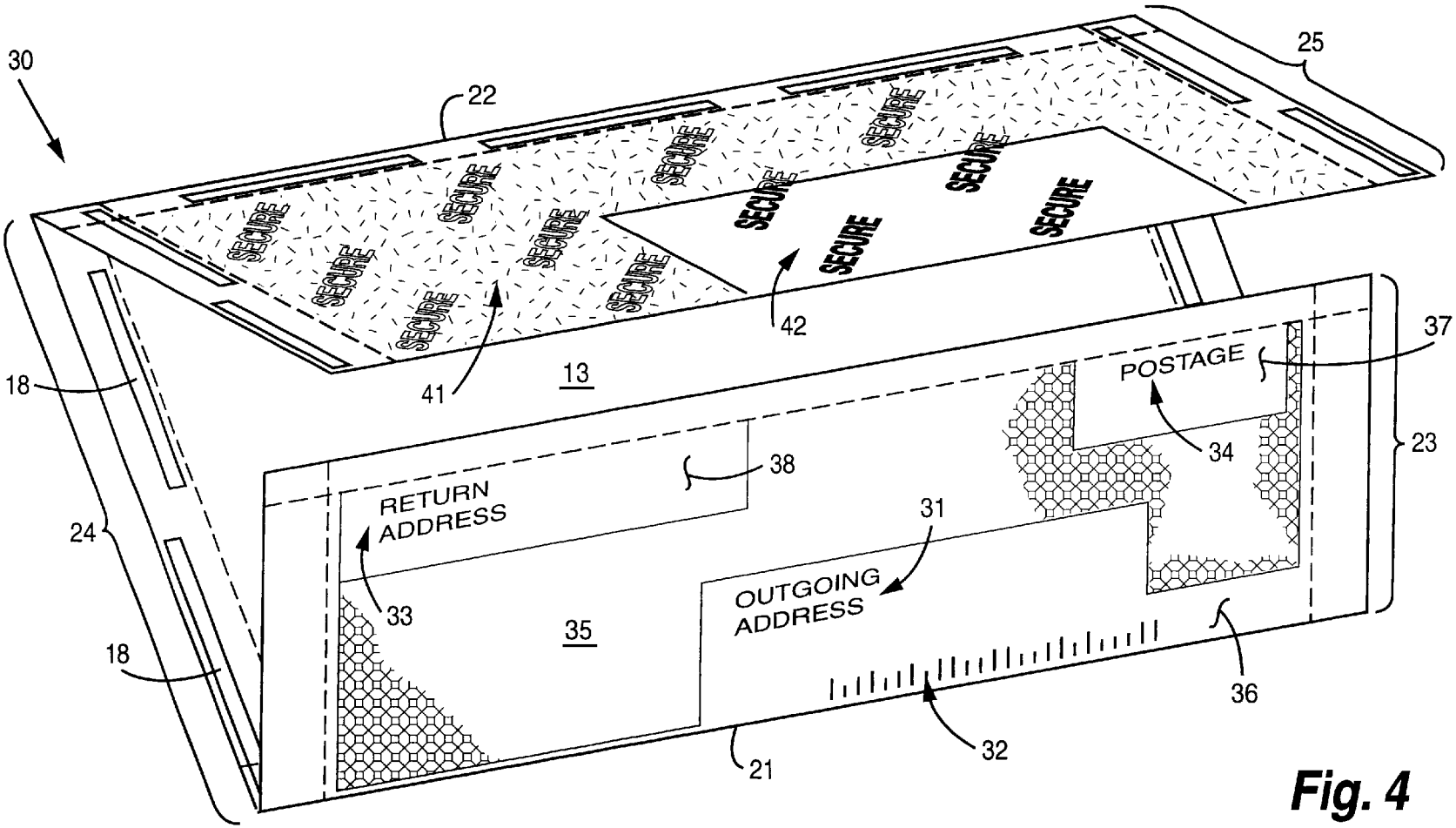
FIG. 4 is a top perspective view showing the intermediate of FIGS. 1 through 3 being C-folded into a mailer type business form according to the invention.

In the embodiment illustrated in FIGS. 1 through 4, the intermediate 10 of FIGS. 1 through 3 is C-folded about the lines of weakness 21, 22 to form the business form 30 illustrated in FIG. 4. The form 30 includes the first face 12 of the first panel 23 which ultimately has outgoing address—both human readable, 31, and bar code, machine readable, 32—indicia thereon, as well as return address indicia 33 and postage indicia 34 (see FIG. 4). The face 12 may have a pantograph, camouflage, or other security-type printing thereon—as illustrated schematically by the areas 35 in FIGS. 2 and 4—but at least the outgoing address indicia 31, 32 area—shown generally by reference numeral 36—and the postage indicia 34 area—shown generally by reference numeral 37—in FIGS. 1 and 4 is free of the printing 35, being essentially the blank (plain) white paper (or colored paper) of the sheet 11. The return address indicia 33 area, shown generally by reference numeral 38 in FIGS. 2 and 4, may also be a plain underlying sheet 11, or may have a lighter form of the pantograph, camouflage, or security printing 35 thereon.

On the first face 12 of the second panel 24 of the intermediate 10, as illustrated in FIG. 2, another unprinted area 39 may be provided while the face 12 of the panel 24 is otherwise covered by a pantograph, camouflage, or security printing 40 like the printing 35. The area 39 may be left unprinted because it will—in the final mailer 30 of FIG. 4—be aligned with the security feature of the invention, and therefore no printing 40 is necessary. The area 39 may thus also be provided for other indicia as the user of the mailer 30 may require.

The novel feature according to the present invention is illustrated most clearly in FIG. 3, and is shown in the exemplary embodiment illustrated in the drawings with respect to the first face 12 of the third panel 25. However it should be understood that depending upon the particular type of business form, or mailer type business form, with which it is utilized according to the invention, the novel security feature according to the invention may be associated with other panels or portions of the form 30 or intermediate 10.

As seen in FIG. 3, the face 12 of the third panel 25 includes a first area 41 and a second area 42 distinct from the first area 41. The first area 41 has security indicia 43—in this case the word "secure", but any other word, symbol, logo, or design that provides a security feature for a negotiable instrument or the like—is positively imaged in white ink thereon. The white ink forming the indicia 43 preferably is non-fluorescent white ink, and is fairly dense, e.g. having a density of about 12–14 lbs. per gallon (e.g. about 13 lbs. per gallon). One particularly suitable commercial white ink for this purpose is sold by Ron Ink Company, Inc. of Rochester, N.Y. under the trademark "LASERSAFE", product designation 213350 (white) which typically includes varnish, pigments, linseed oil, and cobalt, and may include barium compounds, soybean oil, technical white oils, and kaolin clay.

The second area 42 is substantially covered by white ink, as indicated by reference numeral 44, the white ink being opaque and making the business form 30 essentially completely opaque in the area 42. Security indicia 45 (again indicated by the word "secure", but being any suitable words, symbols, logos, or the like) is reverse imaged on the white ink 44. That is where the actual letters of the indicia 45 in FIG. 3 are present there is no white ink, but rather the underlying substrate of the paper sheet 11. The white ink 44 is preferably also LASERSAFE™ ink as described above with respect to the ink for the indicia 43.

As seen in FIG. 3, preferably the areas 41, 42 are immediately adjacent each other (having one or more border lines, as indicated schematically at 46 in FIG. 3), and some security indicia extends from the first area 41 into the second area 42. In this case the security indicia extending from one area 41 to the other 42 is positively imaged white ink 43 in the first area 41, and reverse imaged indicia 45 surrounded by white ink 44.

In the embodiment illustrated in the drawings the third panel 25 comprises a security document, such as a bank check, money order, negotiable instrument, or the like. Particularly the second face 13 of the third panel 25 includes the indicia illustrated in FIG. 1 which includes a payment amount indicia 50, date indicia 51, payee indicia 52, bank indicia 53, authorizing signature indicia 54, and the like. On the face 12 of the panel 25—as seen in FIG. 3—may be other associated security and document indicia, such as lines and indicia for an endorsing signature, as illustrated generally at 56 in FIG. 3.

For the particular embodiment illustrated in the drawings, according to the invention, in the construction of the mailer type business form 30 from the intermediate 10 the sheet 11 is first folded about the line of weakness 22 to bring the second face 13 of the third panel 25 into contact with the second face 13 of the second panel 24, and then the first panel 23 is folded about the line of weakness 22 so that the second face 13 of the third panel 23 comes into contact with the first face 12 of the third panel 25. That is, the intermediate is C-folded to produce form 30. The form 30 is then passed through a conventional sealing mechanism (the exact mechanism dependent upon the type of cohesive or adhesive 18 that is utilized) to form the completed mailer. The mailer 30 is then sent out to the outgoing addressee 31 who opens up the mailer, endorses at 56 and then cashes the security document 49 (see FIG. 1) provided by the third panel 25 of the sheet 11.

While the invention has been described specifically with respect to a single sheet three panel C-folded mailer, it is to be understood that the invention is equally applicable to other types of single sheet mailers or multiple sheet business forms. For example the invention is applicable to Z-fold (either eccentric or standard) mailers, V-fold mailers, eccentric C-fold mailers, double fold mailers, double-C fold mailers, or the like, depending upon the number of panels and configuration. Also the invention is applicable to business forms that are not mailers, or to mailer type business forms that include inserts such as security documents (like negotiable instruments), and/or return envelopes.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and products.

What is claimed is:

1. A business form comprising:

a sheet of paper having first and second areas;

said first area having security indicia positively imaged in white ink thereon; and said second area substantially covered by white ink with security indicia reverse imaged thereon.

2. A business form as recited in claim 1 wherein said first and second areas are immediately adjacent each other.

3. A business form as recited in claim 2 wherein some security indicia extends from said first area to said second area, being positively imaged white ink in said first area, and reverse imaged indicia surrounded by white ink in said second area.

4. A business form as recited in claim 3 wherein said business form is a mailer type business form.

5. A business form as recited in claim 4 wherein said white ink in both said first and second areas is non-fluorescent.

6. A business form as recited in claim 5 wherein said white ink has a density of about 13 lbs/gallon.

7. A business form as recited in claim 5 further comprising a third area, and wherein said third area has a security pantograph thereon.

8. A business form as recited in claim 7 further comprising a fourth area, said fourth area having security printing over a portion thereof, and portions distinct from said security printing receiving outgoing address indicia and postage indicia.

9. A business form as recited in claim 1 wherein said white ink in both said first and second area is non-fluorescent.

10. A business form as recited in claim 1 wherein said business form is a mailer type business form.

11. A business form as recited in claim 10 further comprising a third area, said third area having security printing over a portion thereof, and portions distinct from said security printing receiving outgoing address indicia and postage indicia.

12. A business form as recited in claim 1 wherein said white ink has a density of about 13 lbs/gallon.

13. A mailer type business form comprising:

a substantially quadrate sheet of paper having first and second faces, substantially parallel top and bottom edges, and substantially parallel side edges substantially perpendicular to said top and bottom edges;

at least one line of weakness substantially parallel to said top and bottom edges and dividing said sheet into at least first and second panels;

said first face of said first panel having outgoing address, return address, and postage indicia thereon; and another face or panel of said sheet aside from said first panel first face having first and second areas, said first area having security indica positively imaged in white ink thereon; and said second area substantially covered by white ink with security indicia reverse imaged thereon.

14. A mailer type business form as recited in claim 13 wherein said first and second areas are immediately adjacent each other.

15. A mailer type business form as recited in claim 14 wherein some security indicia extends from said first area to said second area, being positively imaged white ink in said first area, and reverse imaged indicia surrounded by white ink in said second area.

16. A mailer type business form as recited in claim 13 wherein said first face of said first panel has security printing over a portion thereof, and portions distinct from said security printing receiving said outgoing address indicia and said postage indicia.

17. A mailer type business form as recited in claim 13 wherein at least two lines of weakness substantially parallel to said top and bottom edges are provided, dividing said sheet into at least first, second, and third panel, said second panel adjacent said first panel, and said third panel on the opposite side of said second panel from said first panel; and wherein said another face or panel of said sheet aside from said first panel first face comprises said first face of said third panel.

18. A mailer type business form as recited in claim 17 wherein said sheet consists of said first, second and third panels; and wherein said mailer is a C-fold type mailer.

19. A mailer type business form as recited in claim 17 wherein said third panel, when separated from the rest of said sheet, comprises a security document with security document indicia imaged on at least said second face of said third panel.

20. A mailer type business form as recited in claim 13 wherein said white ink in both said first and second areas is non-fluorescent.

* * * * *